US008704665B2

(12) United States Patent
Yang

(10) Patent No.: US 8,704,665 B2
(45) Date of Patent: Apr. 22, 2014

(54) MULTIPLE TECHNOLOGY EAS TAG AND SYSTEM

(75) Inventor: Xiao Hui Yang, Los Altos, CA (US)

(73) Assignee: WG Security Products, Campbell, CA (US)

( * ) Notice: Subject to any disclaimer, the term of this patent is extended or adjusted under 35 U.S.C. 154(b) by 366 days.

(21) Appl. No.: 12/815,349

(22) Filed: Jun. 14, 2010

(65) Prior Publication Data

US 2010/0315238 A1 Dec. 16, 2010

Related U.S. Application Data

(60) Provisional application No. 61/187,241, filed on Jun. 15, 2009.

(51) Int. Cl.
*G08B 23/00* (2006.01)
*G08B 13/14* (2006.01)

(52) U.S. Cl.
USPC ..... 340/572.9; 340/568.1; 340/539.1; 340/539.3; 340/572.2; 340/572.8

(58) Field of Classification Search
USPC ..... 340/572.9, 572.1, 572.2, 572.5, 10.1, 340/505, 568.1, 539.1, 539.3, 572.8, 10.3, 340/10.42; 206/701; 24/704.1, 703.1; 701/57.1
See application file for complete search history.

(56) References Cited

U.S. PATENT DOCUMENTS

| | | | | |
|---|---|---|---|---|
| 4,944,075 | A | 7/1990 | Hogan | |
| 5,031,287 | A | 7/1991 | Charlot, Jr. et al. | |
| 5,054,172 | A | 10/1991 | Hogan et al. | |
| 5,293,674 | A * | 3/1994 | Hendrikx | 24/704.1 |
| 5,680,681 | A | 10/1997 | Fuss | |
| 6,029,322 | A | 2/2000 | Belotti et al. | |
| 6,285,286 | B1 | 9/2001 | Tyren et al. | |
| 7,183,917 | B2 * | 2/2007 | Piccoli et al. | 340/572.1 |
| 7,190,272 | B2 | 3/2007 | Yang et al. | |
| 7,400,254 | B2 | 7/2008 | Yang et al. | |
| D578,030 | S | 10/2008 | Yang et al. | |
| 7,474,222 | B2 | 1/2009 | Yang et al. | |
| 7,523,630 | B2 * | 4/2009 | Skjellerup | 70/57.1 |
| D599,242 | S | 9/2009 | Yang | |
| 7,652,574 | B2 | 1/2010 | Sayegh | |
| 7,990,273 | B2 * | 8/2011 | Handyside et al. | 340/572.9 |
| 2008/0202407 | A1 | 8/2008 | Jorgensen | |
| 2008/0266111 | A1 * | 10/2008 | Shute et al. | 340/572.9 |
| 2009/0058659 | A1 | 3/2009 | Handyside et al. | |
| 2009/0289798 | A1 | 11/2009 | Yang | |
| 2010/0095495 | A1 * | 4/2010 | Nguyen et al. | 24/704.1 |

* cited by examiner

*Primary Examiner* — Daniel Wu
*Assistant Examiner* — Mancil Littlejohn, Jr.
(74) *Attorney, Agent, or Firm* — Waters Law Group, PLLC; Robert R. Waters; Brian W. Foxworthy

(57) ABSTRACT

An electronic article surveillance (EAS) tag incorporates alternative theft deterrence systems. The security tag incorporates both a benefit-denial ink-based system and two independent EAS detection elements operating at two different frequencies such that the tag can alternatively be operated in two different systems. The security tag is further adapted to be reusable after ink ampoule breakage and includes a visual indication of ink to serve as a further visual deterrence to shoplifters.

9 Claims, 7 Drawing Sheets

MULTIPLE TECHNOLOGY EAS TAG AND SYSTEM

CROSS REFERENCE TO RELATED APPLICATIONS

This application claims priority to U.S. Provisional Application 61/187,241 filed on Jun. 15, 2009. The entire disclosure contained in U.S. Provisional Application 61/187,241, including the attachments thereto, is incorporated herein by reference.

FIELD OF THE INVENTION

This application discloses claims and embodiments generally related to a multiple technology electronic article surveillance ("EAS") tag and system, and more particularly, a tag and system utilizing multiple EAS frequency platforms for operating two separate and independent EAS protection schemes, while further embodying a benefit denial system.

MOTIVATION OF THE INVENTOR

A. Description of the State of the Art

Electronic article surveillance systems have been used for many years as a means of deterring retail shoplifting in clothing stores, electronic stores, and a myriad of other retail establishments. Generally speaking, an EAS system will begin with a tag, consisting of a durable and reliable, yet small, sensor tag which is affixed to the article to be detected in such a way that it cannot be easily removed by a customer in the store. Usually, the system depends upon the feature that the attachment mechanism is constructed such that it can only be removed by the use of a specialized tool which is only in the possession of the store personnel at the checkout register or exit port for the establishment. In the event that an EAS tag is not removed from a protected article prior to exiting the store, an alarm or other signal is activated.

In many commercially available EAS systems, one or more antennas are placed at the exits and entrances to the retail location. These antennas set up zones, sometimes referred to as interrogation zones, in which an EAS tag (or marker) may be sensed. At least one antenna serves the function of sending out what is called an interrogation signal. The markers on the merchandise are affected by this signal and will respond with a signal of their own. Either the same antenna that sends out the interrogation signal or other additional antennas can sense the signals from the markers. The most effective way to do this is by stopping the broadcast of the interrogation signal to listen for the signals emanating from the markers. If a marker is sensed within the zone created by the antennas, it is presumed that an article is being removed without purchase, and alarms are set off. These alarms may be audible alarms for general broadcast or the alarms may be silent alarms in the form of a light at a check-out counter or security station, etc.

In order to make an EAS system effective, it is important to make the tag articles as versatile as possible. In many instances, the tags are installed at a centrally located distribution center, and shipped on the merchandise to retailers across the country. For this reason, it is quite possible that when the tags are applied, it may not be completely known what type of protection scheme is available in a particular retail setting. Accordingly, it could be highly beneficial to create a tag article that can be used in different EAS technology platforms.

Presently, there are two primary EAS technology platforms that are commercially dominant in retail environments throughout North America. Each of those systems is dependant upon the creation of a resonant operational frequency. Specifically, the two dominant frequencies are 58 kHz systems and 8.2 MHz systems. In effect, the label or tag is constructed from material that is tuned to be operationally detectible at either 58 kHz or 8.2 MHz. In each system, the central operational feature is the broadcast of the operational frequency into the interrogation zone in order to excite any tag article that has entered the zone. Thus, the tag article must be created such as to "ring" at the same preset frequency, within expected levels of tolerance. The excitation EAS element resident within the tag can take a variety of forms in the prior art. One method that has achieved widespread use is a ferrite-coil combination.

Because the two commercially dominant frequency platforms are in widespread use, but are significantly different, most establishments purchase and utilize one system over the other system for extended periods of time, largely because of installation and replacement costs that are imposed by the systems. However, within a retail chain that utilizes centralized purchasing, the chain may find themselves with some retail establishments with 58 kHz systems while others have 8.2 MHz systems. Being able to freely shift merchandise between the two stores without the need for retagging is highly preferred.

Benefit denial systems have long been used in EAS tags for theft deterrence. The most prevalent form of benefit denial tags incorporates the use of frangible ink vials. In the event that a thief attempts a brute force breaking of the tag to remove it from the protected article, the bending and the pulling on the tag causes one or more ink vials to break, leaking a staining ink on the protected article. Ink based systems are often used on clothing items and the destruction of the clothing by permanent staining serves as a deterrent to the potential thief who is contemplating a theft attempt.

Prior art ink tags have generally used two ink vials that are disposed in the interior of the tag in close vicinity to the tack shaft in order to facilitate immediate contact of the ink to the clothing. While such arrangements have utility, they also create a disadvantage that the ink feature may not be visually apparent to the shopper who is considering an opportunity to shoplift. Accordingly, it would be advantageous to create a different construction in which a large ink ampoule is prominently present on the surface of the tag to serve as a visual deterrent by making it clear that an ink stain will result from an attempt to break off the tag.

Another key feature of prior art ink tags is that they are not reusable in the event of an ink vial breakage. Due to the location of the ink vials, breakage results in contamination of the entire tag, such that the EAS signal element is generally destroyed or comprised. The tag is difficult to clean and the ink vials are often sealed within the enclosure such that a broken vial is often difficult or impossible to replace in the retail setting. It is an important improvement to create an ink based tag in which the ink vials would be replaceable, as is the case with the present invention. In addition, it would be advantageous to construct a tag such that at least a portion of the tag could be easily re-used with a minimal amount of cleanup and reconditioning in the event of an ink vial breakage.

The present application represents an improvement in EAS tags and systems. One improvement presented includes the use of materials that generate a harmonic resonant signal detectible by the 8.2 MHz systems while also containing or including materials that generate a harmonic resonate signal detectible by the 58 kHz systems, respectively. Another improvement includes the use of multiple signal systems in combination with a benefit-denial component, such as dye or ink, providing multiple levels of efficiency and theft deterrent qualities. By providing such a tag, and therefore a system or systems utilizing such a tag or tags, a supplier may produce a single tag that satisfies both the 58 kHz and 8.2 MHz detection systems presently used in the market, as well as providing an additional layer of theft deterrence via the benefit-denial component included therein.

This application presents one or more embodiments that fulfill a need or needs not yet satisfied by the products and inventions previously or presently available. In particular, the embodiments disclosed herein describe a tag and system utilizing the tag that provides an unanticipated and non-obvious combination of features distinguished from the products and inventions preexisting in the art. The applicant is unaware of any product, disclosure or reference that discloses the features of the claims and embodiments disclosed herein, and as more fully described below.

SUMMARY OF THE INVENTION

In accordance with one embodiment, an electronic article surveillance tag is described and depicted, the tag comprising a pair of shells mutually coupled by the use of a pin and a ball-clutch mechanism. The tag comprises materials for generating signals detectible by 58 kHz and/or 8.2 MHz detection systems, or in combination signals detectible by both systems. The tag further comprises a benefit-denial component having a frangible compartment possessing a staining dye or ink capable of bleeding onto the article that is to be protected. The pin head engages and fractures the frangible compartment when the tag is forcibly manipulated in an attempt to remove it from the article, thereby exposing the dye or ink to the material.

In accordance with another embodiment, an EAS tag is disclosed featuring an ink-based benefit denial component that is visually apparent on the surface of the tag. The presence of an ink ampoule serves as a further deterrence to the potential shoplifter. In a further embodiment, the ampoule is sufficiently separated and sealed from the EAS signal generating elements such that the EAS function itself is not compromised in the event of an ink ampoule breakage. Thus, the portion of the tag containing the EAS elements may be cleaned and re-used as they will not be destroyed by ink contamination. In yet a further embodiment, an ink tag is disclosed in which an ink vial or ink ampoule may be replaced in the retail store as opposed to throwing away the entire tag.

DESCRIPTION OF THE EMBODIMENTS

Figure 1:
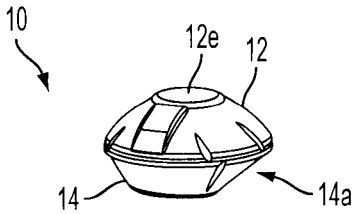
FIG. 1 is a perspective view of one particular tag embodiment made pursuant to the present invention.
Figure 7:
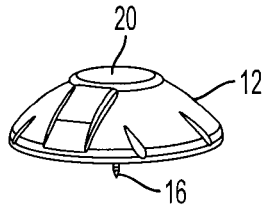
FIG. 7 is a perspective view of the first shell.
Figure 2:
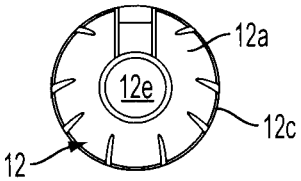
FIG. 2 is a top view of the tag of FIG. 1.
Figure 4:
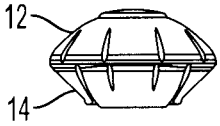
FIG. 4 and FIG. 5 are opposing front and rear views of the tag of FIG. 1.
Figure 6:
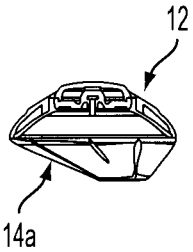
FIG. 6 is a side view of the tag of FIG. 1.
Figure 5:
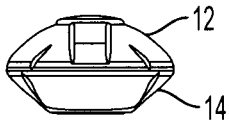
Figure 3:
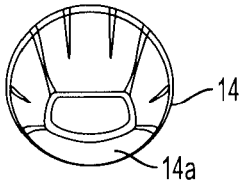
FIG. 3 is a bottom view of the tag of FIG. 1 and FIG. 2.
Figure 8:
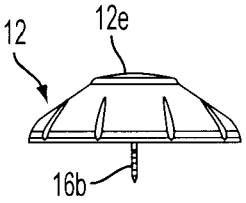
FIG. 8 and FIG. 9 are opposing side view of the first shell of FIG. 7.
Figure 10:
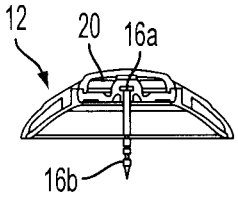
FIG. 10 is a sectional view of FIG. 8 or FIG. 9.
Figure 9:
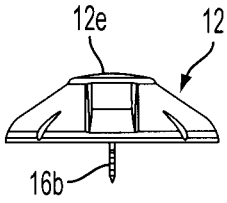

Generally, an electronic article surveillance ("EAS") tag 10 is depicted and described in FIG. 1 through FIG. 12, respectively, the tag 10 comprising a first shell 12 and a second shell 14 mutually coupled. The shells 12 and 14 are mutually coupled via a pin 16 received and retained by a clutch 18. Collectively, the shells 12 and 14 house at least one benefit denial device 20 and at least two signal generation elements 22 detectible by different EAS detection systems.

Figure 11:
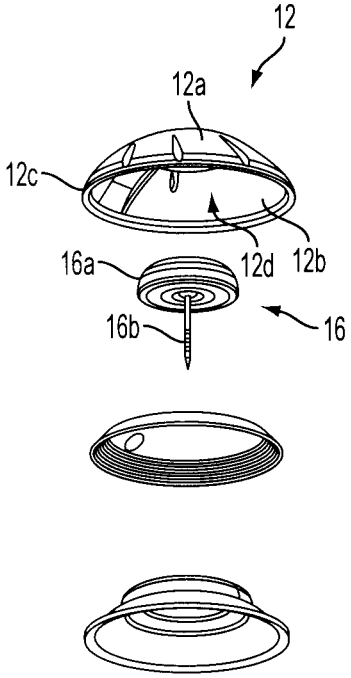
FIG. 11 is an exploded perspective view of the first shell as viewed toward the interior void of the shell.

In one embodiment of the invention, generally, the first shell 12 comprises an exterior surface 12*a* and a corresponding interior surface 12*b*, the surfaces intersecting and defining a perimeter 12*c*. The surfaces 12*a*, 12*b* and perimeter 12*c* define a volume or void 12*d*. In another embodiment, the first shell 12 may further include a window 12*e*. The benefit denial device 20 may be retained at or near the center of the surfaces 12*a*, 12*b* and void 12*d*. In an embodiment having a window 12*e*, the benefit denial device 20 may be viewable through the window 12*e* in whole or in part. Within the shell 12, the pin 16 has a head 16*a* and an elongated shaft 16*b* depending therefrom. The head 16*a*, as shown in FIG. 11, is retained in a proximate cooperative relationship with the benefit denial device 20. In one embodiment, the benefit denial device 20 may be integrally constructed with pin head 16*a*. The shaft 16*b* projects from the shell 12 to pierce through the material (s) of the article to be protected, the shaft 16*b* engaging a bore defined by the clutch 18 retained by the shell 14, thereby joining the shells 12 and 14.

The benefit denial device 20 may comprise a variety of materials or configurations, including at least one frangible element such as an ampoule, bubble or casing possessing a dye or ink that stains the material to which the tag 10 is affixed. The ampoule, bubble, casing or other configuration (s) comprise material(s) that are frangible so as to release the dye or ink onto the material. In a preferred embodiment, the frangible ampoule is arranged such that it is formed on the head 16*a* of a shaft. The top of the benefit denial ampoule can be made of a clear or translucent material in a preferred embodiment such that the ink is visible to a shopper or would-be shoplifter.

The head 16*a* is positioned adjacent to the benefit denial device 20. Once the shaft 16*b* is impinged with the clutch 18, a forcible attempt to remove the tag 10 from the article will cause the head 16*a* to puncture or fracture the benefit denial device 20 and release the dye or ink housed therein.

Figure 12:
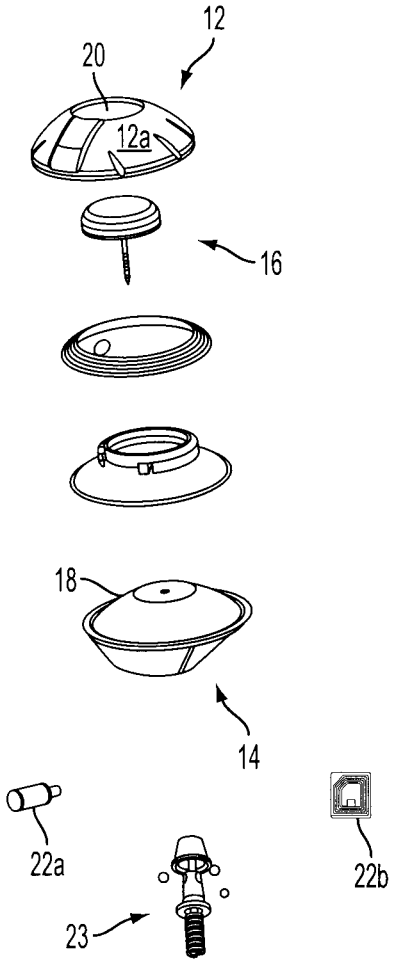
FIG. 12 is an exploded perspective view of the tag as viewed from along the top of the shell.
Figure 13:
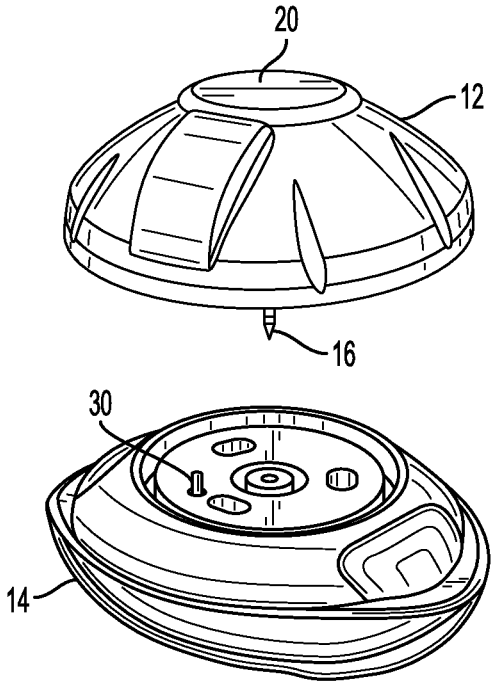
FIG. 13 is a perspective view of an embodiment of the tag having a switch.
Figure 14:
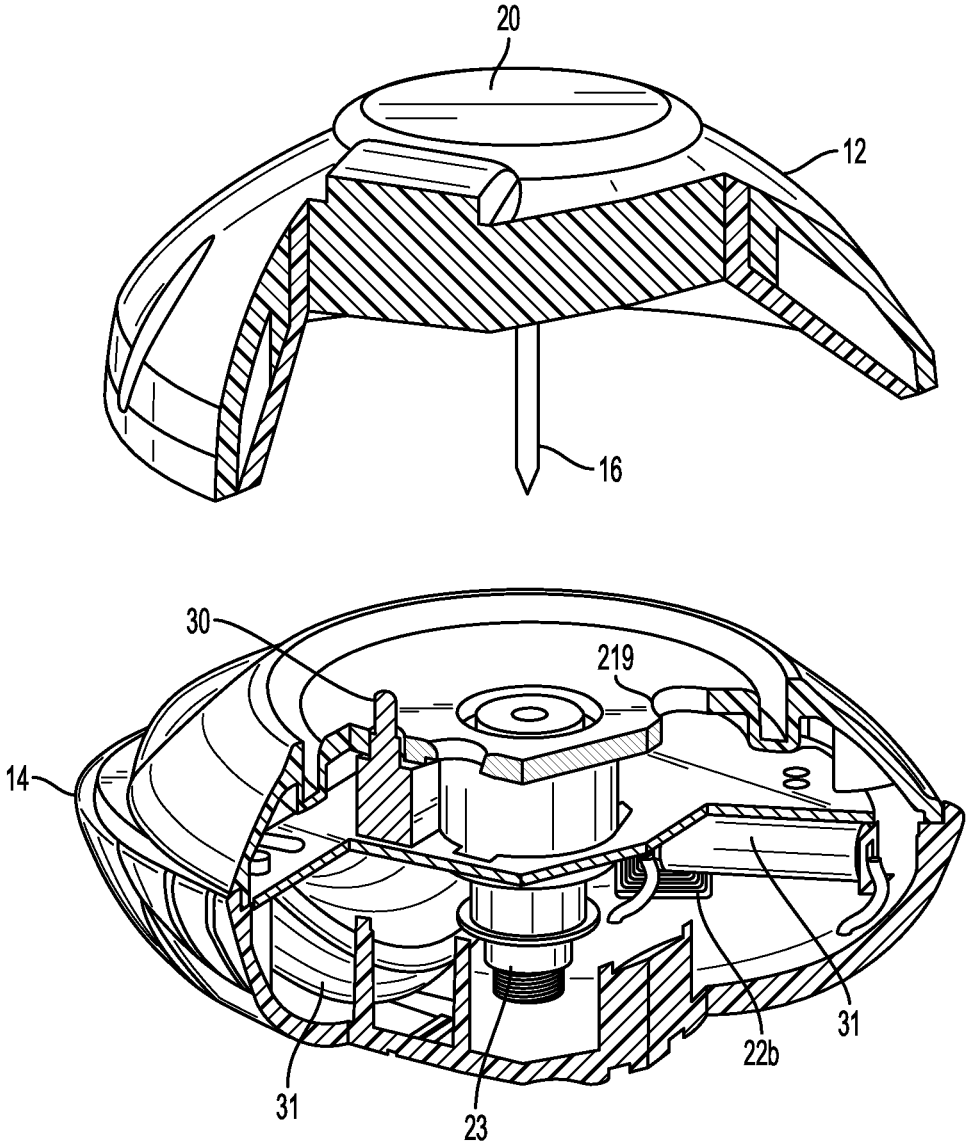
FIG. 14 is a sectioned perspective view of an embodiment of the tag having a switch.

The signal generation elements 22*a* and 22*b* shown in FIG. 12 resident within the tag 10 are generally contemplated as being those compatible with the two dominant frequency platforms, specifically a 58 kHz detection system arrangement and a 8.2 MHz detection system arrangement, respectively. As such, one embodiment of the invention may comprise multiple ferrite elements or mechanically resonant materials generating the appropriate detectible signal(s) for each system. For example, a resonator and bias material arrangement suitable for 8.2 MHz detection antenna(e) may be included in the first shell 12 of the tag 10, and a resonator and bias material arrangement suitable for 58 kHz detection antenna(e) may be included in the second shell 14 of the tag 10, respectively. In another embodiment of the invention, it is envisioned that the arrangement of the 8.2 MHz and the 58 kHz materials may be reversed, so that the 58 kHz materials are in the first shell 12 and the 8.2 MHZ materials are in the second shell 14, respectively. Moreover, the two detection systems may utilize separate ferrite coils configured to resonate at each of the target frequencies. As yet another possibility, tag 10 could utilize a single ferrite at one of the dominant frequencies and a mechanically resonant material at the other dominant frequency.

It is understood that the two EAS frequency-based protection systems are essentially separate and distinct from each other electrically and operationally. Appropriate care must be taken in the manufacturing process to insure that the two EAS systems do not interfere with the operation of each other. It may also be desirable to seal the two EAS elements such as to not affect the systems by the presence of free-flowing ink from the benefit denial system. Even in the event of a tampering incident that breaks the ink ampoules, it would generally be desirable to keep the EAS alarming function operational.

The clutch 18 may include a variety of arrangements and configurations. One variation may include a three-ball clutch, wherein the three balls are inwardly biased to define a bore into which the shaft 16*b* may be inserted and impinged thereby. An example of that arrangement can be found in FIG. 12 wherein a three-ball clutch 23 is shown. The shaft 16*b* (see FIG. 8) of pin 16 may be released by use of a magnetic detacher, wherein the magnetic properties of the detacher release the three balls and thereby releasing the shaft 16*b* from the clutch 18. The shells 12 and 14 may be separated from the article and stored for reuse by application to another article. Thus, in this manner, the denial-benefit component of the tag 10 is controlled at the point-of-sale and is resistant to excessive tampering.

Similarly to the first shell 12, the second shell 14 comprises an exterior surface and an interior surface intersecting along a perimeter and defining a void or space on an interior side of the second shell 14. It is envisioned that the second shell 14 may have a geometry similar to that of the first shell 12, which may include dome or hemispherical shapes. It is also envisioned that the second shell 14 may have a sloped surface 14*a*.

Figure 15:
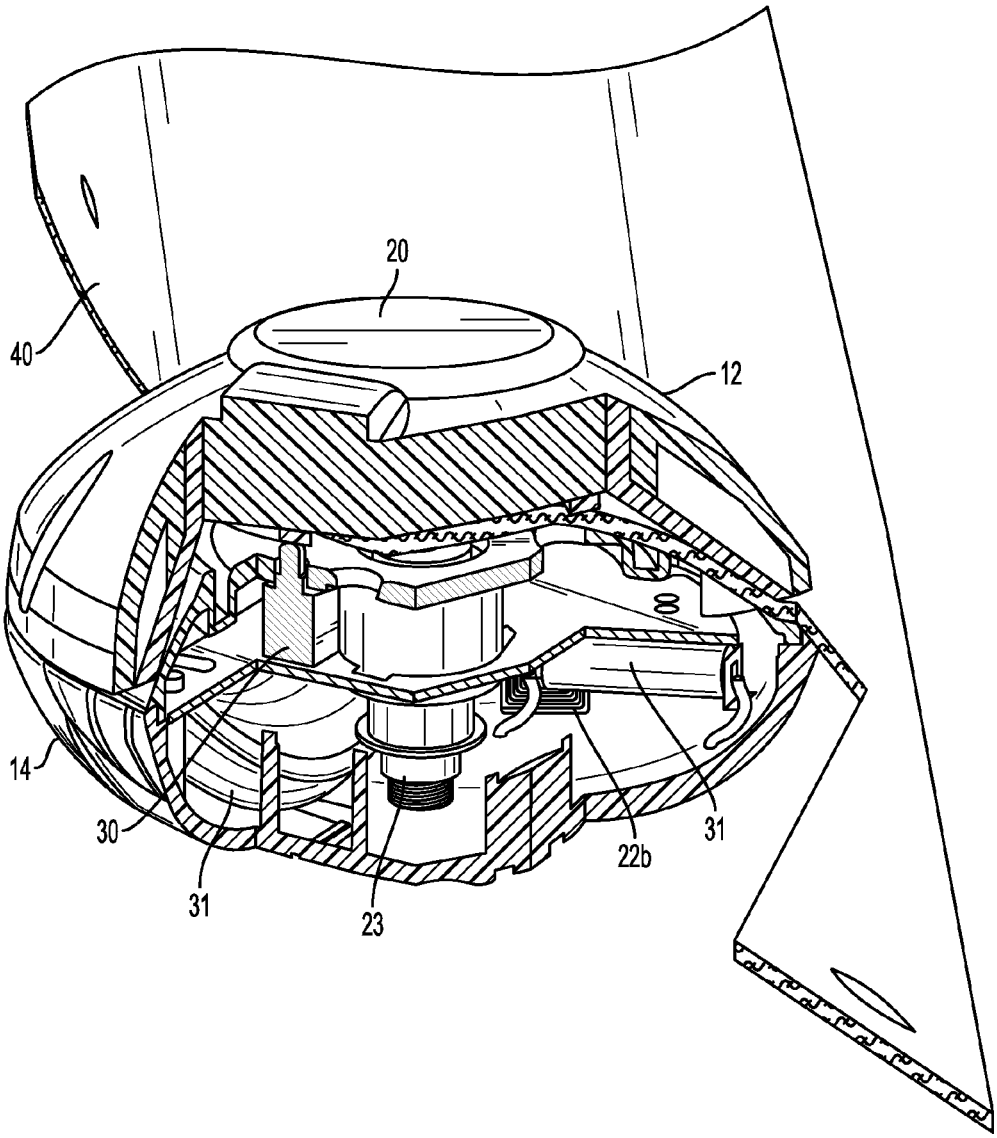
FIG. 15 is a sectioned perspective view of the tag of FIG. 14 with an object attached and the second housing portion depressing the switch.
Figure 16:
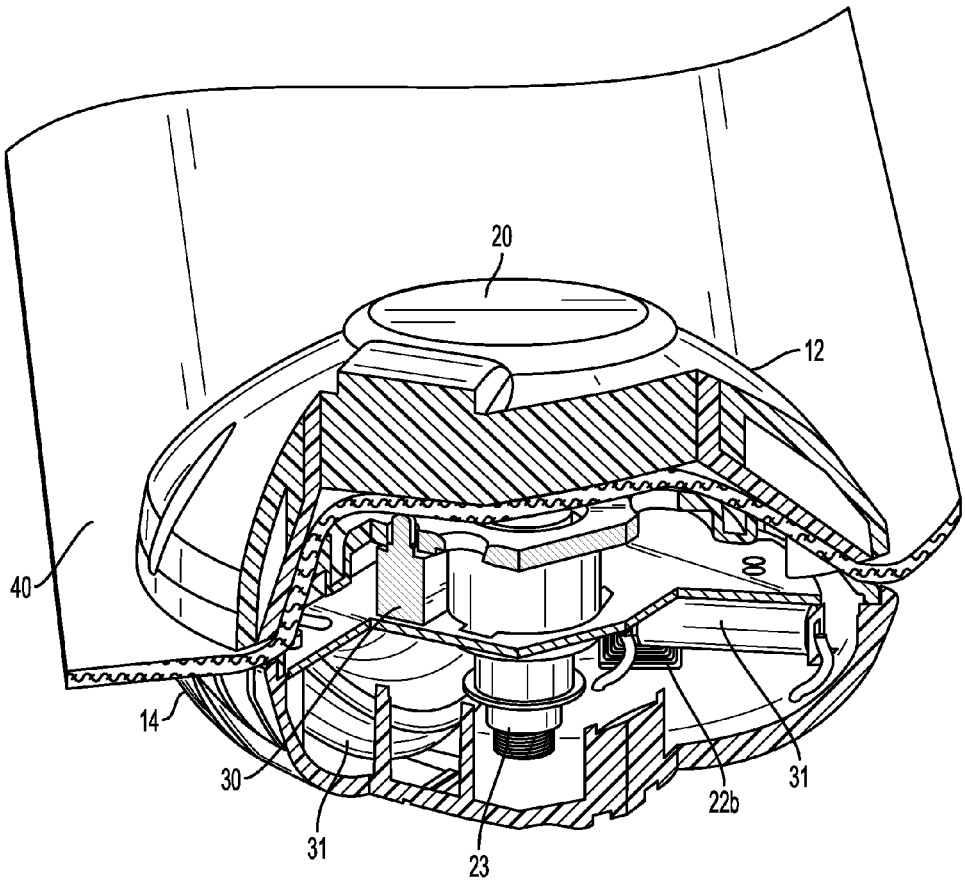
FIG. 16 is a sectioned perspective view of the tag of FIG. 14 with an object attached and depressing the switch.

As shown in FIGS. 13-16, further embodiments of tag 10 may carry an on-board power supply such as battery 31, along with audible alarm generator 32, and switch 30. In FIG. 15, switch 30 is located on second shell 14 such that it is contacted by first shell 12 when the tag 10 is attached to an item. In the embodiment of FIG. 15, a raised ring on the bottom of first shell 12 contacts switch 30. As shown in FIG. 16, in some situations, when tag 10 is attached to item 40, it will be item 40 that contacts switch 30 and changes the state of switch 30. Forcible removal of first shell 12 from second shell 14 would result in a change of state the switch 30, causing audible alarm generator 32 to sound an alarm. This adds an additional level of protection by drawing attention to a tag that has been tampered with.

It is to be understood that the embodiments and arrangements set forth herein are not limited in their application to the details of construction and arrangement of the components set forth in the description and illustrated in the drawings. Rather, the description and the drawings provide examples of the embodiments envisioned, but the invention is not limited to the specific embodiments. The embodiments disclosed herein are further capable of other embodiments and of being practiced and carried out in various ways, including various combinations and sub-combinations that may not have been explicitly disclosed. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the invention be regarded as including such equivalent constructions.

I claim:

1. An electronic article surveillance device comprising;

a first housing portion and a second housing portion;

said first housing portion including a first electronic article surveillance element operable at a first frequency and a second electronic article surveillance element operable at a second frequency, said first housing portion further including a releasable clutch, said first housing portion having an aperture for access to said releasable clutch;

said second housing portion including an attaching element for attaching said second housing portion with said first housing portion by engaging said releasable clutch to attach the electronic article surveillance device to an item to be protected;

said second housing portion further configured such that a frangible ampoule containing a staining agent is integrated into said second housing portion; and a battery, an audible alarm generator, and a switch in said first housing, said switch extending outside said first housing portion and being contacted when the electronic article surveillance device is installed on said item to be protected.

2. The electronic article surveillance device of claim 1, wherein;

said attaching element is an elongated shaft and said frangible ampoule is integrally formed onto one end of said shaft, and the other end of said shaft constructed such as to releasably engage said releasable clutch.

3. The electronic article surveillance device of claim 1, wherein said ampoule is constructed on the outer surface of said second housing portion and constructed of a clear material such as to allow the staining agent on the interior of the ampoule to be visible.

4. The electronic article surveillance device of claim 1, wherein;

said first electronic article surveillance element and said second electronic article surveillance element are sealed from said releasable clutch to prevent contamination of said first electronic surveillance element and said second electronic article surveillance element by said staining agent when said frangible ampoule is ruptured.

5. The electronic article surveillance device of claim 1, wherein;

said releasable clutch is releasable by application of a magnet to said first housing portion.

6. The electronic article surveillance device of claim 1, wherein said first electronic article surveillance element operates at a frequency of 58 kHz and said second electronic article surveillance element operates at a frequency of 8.2 MHz.

7. The electronic article surveillance device of claim 1, wherein said frangible ampoule can be removed and replaced if broken.

8. The electronic article surveillance device of claim 1, wherein:

said switch is contacted by said second housing portion when the electronic article surveillance device is attached to said item to be protected.

9. The electronic article surveillance device of claim 1, wherein:

said switch is contacted by said item to be protected when the electronic article surveillance device is attached to said item to be protected.

* * * * *